US006128879A

United States Patent [19]

Bussey, Jr. et al.

[11] Patent Number: 6,128,879

[45] **Date of Patent: *Oct. 10, 2000**

[54] INSULATION BARRIER

[75] Inventors: Harry Bussey, Jr., Marco Island, Fla.; Harry Bussey, III, Atlantic Highlands, N.J.

[73] Assignee: CPI Packaging, Inc., Marlboro, N.J.

[ * ] Notice: This patent is subject to a terminal disclaimer.

[21] Appl. No.: 09/033,350

[22] Filed: Mar. 2, 1998

Related U.S. Application Data

[62] Division of application No. 08/764,764, Dec. 12, 1996, Pat. No. 5,766,721, which is a division of application No. 08/547,437, Oct. 24, 1995, Pat. No. 5,617,687.

[51] Int. Cl.[7] ..... E04B 1/74; E04B 5/00

[52] U.S. Cl. ..... 52/408; 52/309.4; 52/269; 52/267

[58] Field of Search ..... 52/309.4, 309.8, 52/309.9, 408, 269, 265, 267, 407.1, 407.3, 407.5, 746.1, 741.3, 741.4

[56] References Cited

U.S. PATENT DOCUMENTS

| | | | |
|---|---|---|---|
| 3,763,614 | 10/1973 | Hyde et al. | 52/408 X |
| 4,078,348 | 3/1978 | Rothman | 52/192 X |
| 4,279,112 | 7/1981 | Bertrand | 52/741.1 |
| 4,359,849 | 11/1982 | Goeman | 52/309.4 X |
| 4,535,581 | 8/1985 | Fujiki et al. | 52/520 X |
| 4,784,891 | 11/1988 | Shickel | 428/137 |
| 4,969,302 | 11/1990 | Coggan et al. | 52/309.8 |
| 5,085,022 | 2/1992 | Paliwoda | 52/309.8 |
| 5,247,770 | 9/1993 | Ting | 52/309.9 |
| 5,367,847 | 11/1994 | Hepler | 52/309.4 |
| 5,495,698 | 3/1996 | Alderman et al. | 52/408 X |

*Primary Examiner*—Beth A. Stephan
*Assistant Examiner*—Brian E. Glessner
*Attorney, Agent, or Firm*—Francis C. Hand; Carella, Byrne, Bain, Gilfillan, Cecchi, Stewart & Olstein

[57] ABSTRACT

The insulation barrier is made with a flexible foam polyethylene substrate and a film which is secured to at least one side of the substrate and which extends from at least one lateral edge of the substrate. The insulation barrier may be supplied in roll form or in panel form. In one embodiment, the film may be provided with a plurality of small holes to permit moisture vapor to pass through under a differential pressure on opposite sides of the barrier. In still another embodiment, the substrate may be provided with spaced apart embossments while the film is provided with pockets receiving the embossments. The barrier has multiple uses as an insulation/vapor barrier for interior and exterior use on buildings including use in roofing, flooring and walls.

19 Claims, 2 Drawing Sheets

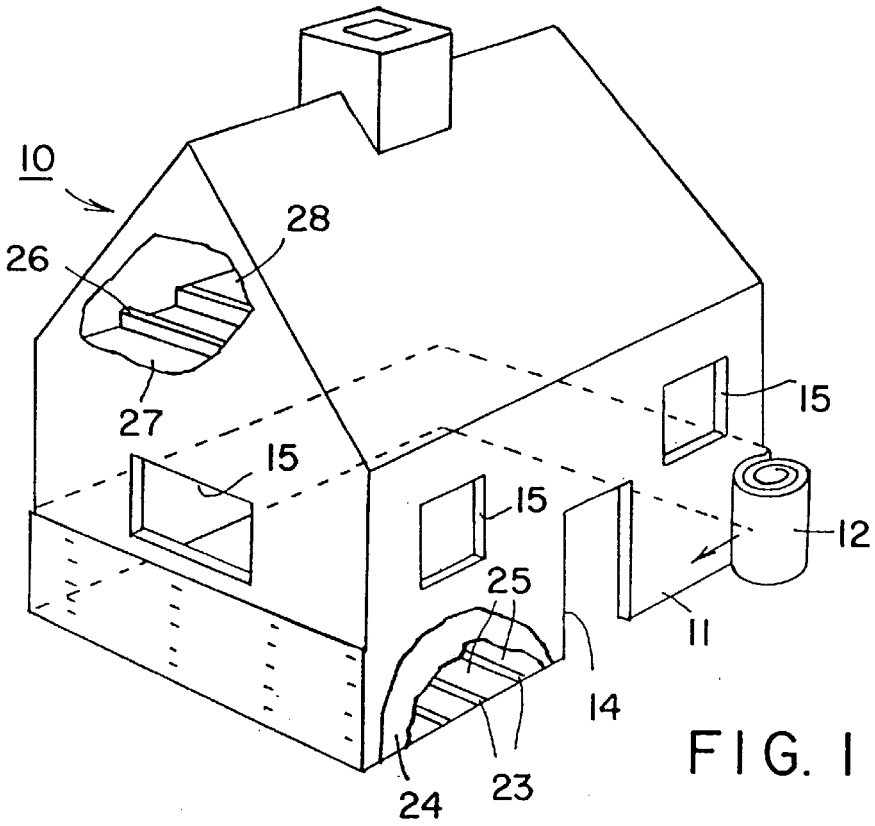
FIG. 1
FIG. 2
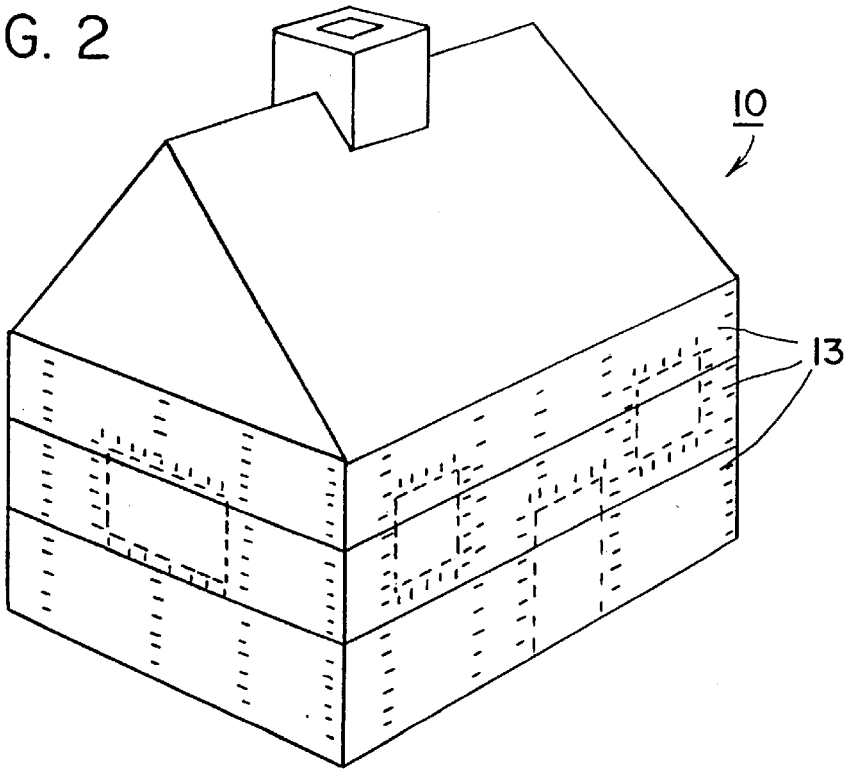

FIG. 3
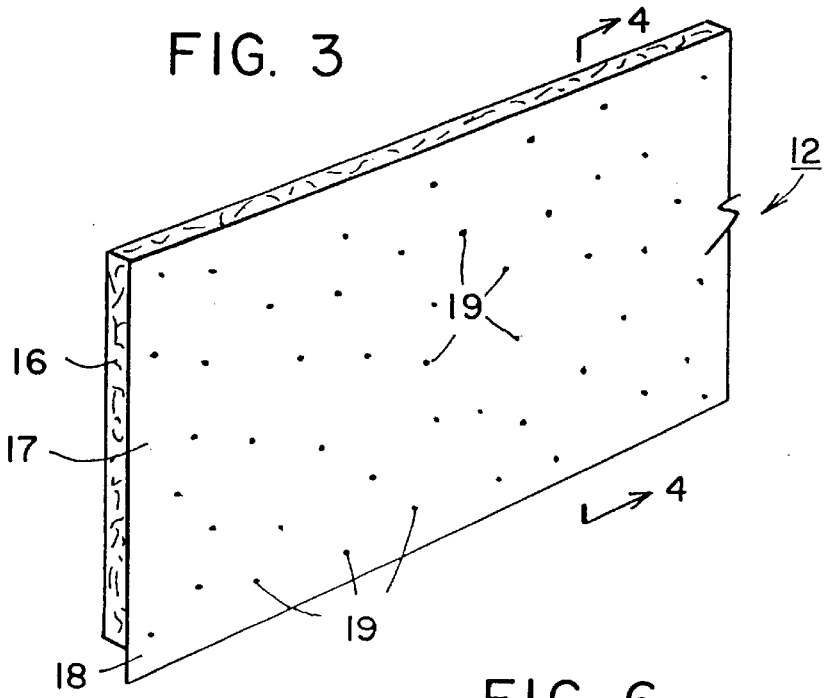
FIG. 6
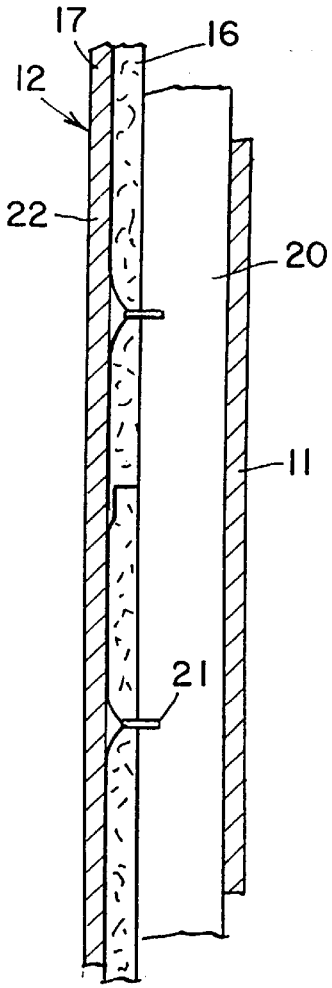
FIG. 5
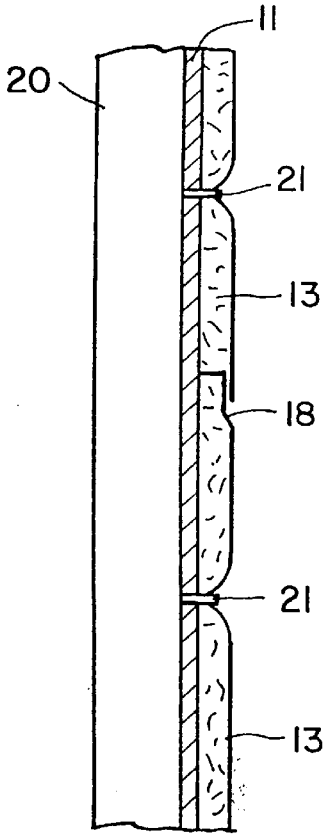
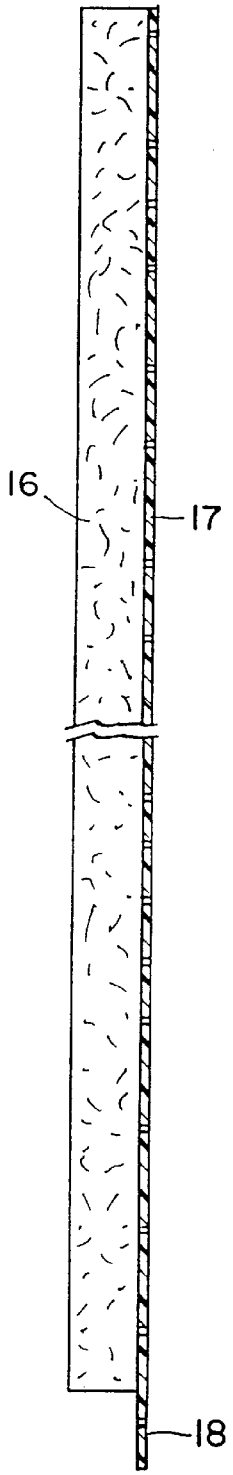
FIG. 4

INSULATION BARRIER

This is a division of application Ser. No. 08/764,764, filed Dec. 12, 1996, now U.S. Pat. No. 5,766,721, which is a division of application Ser. No. 08/547,437, filed Oct. 24, 1995, now U.S. Pat. No. 5,617,687.

This invention relates to an insulation barrier. More particularly, this invention relates to an insulation/vapor barrier made of foamed polyethylene.

As is known, various types of insulation barriers have been known for use in various types of structures such as buildings and boats.

For example, U.S. Pat. No. 4,328,652 describes a method of insulating a residential type building employing a laminated insulating material formed of layers of a reflective coating, a pliable plastic, a pressure-sensitive adhesive and a protective sheet. As described, the insulating material is supplied in rolls. In use, panels or sheets of the insulating material are applied to the exterior of a building under construction with the sheets or panels disposed in overlapping relationship.

Other types of materials have also been known in the construction trades for insulating a building. For example, one well known product is sold under the trademark Tyvek and is supplied in rolls or sheets and is used to encase the sheathing of a building prior to adding a siding of aluminum, wood or brick thereto.

U.S. Pat. Nos. 4,974,382 and 5,134,831 each describes an infiltration barrier used in building construction including a flexible substrate sheet with at least one metalized layer thereon. As described, the barrier sheets may be installed on wall or roof sheathing panels, such as gypsum sheathing panels.

U.S. Pat. No. 5,147,481 describes the use of various plastic foam materials which are used in insulation boards for various types of buildings such as barns. These foam materials may include polyurethanes, polyolefins or polymers or copolymers derived from polymerizable alkenyl aromatic compounds.

U.S. Pat. No. 4,087,296 describes various foam-membrane sandwiches employing a polyurethane pre-foam which is of rigid construction.

U.S. Pat. No. 4,828,635 describes the use of laminated thermal insulation panels wherein a board made of expanded molded polystyrene is provided with an impervious membrane, such as a TYVEK membrane described as a sheet of fine synthetic fibers composed of non-woven spun-bonded olefin.

U.S. Pat. No. 3,121,649 describes the use of an insulating blanket formed of fibrous materials such as fiberglass or rockwool.

In general, the types of insulation products which have been known are of relatively expensive construction or require a relatively large amount of manual labor and time in order to install.

Accordingly, it is an object of the invention to provide an insulation barrier of relatively simple inexpensive construction which can be readily put in place.

It is another object of the invention to provide an insulation barrier which has multiple uses.

It is another object of the invention to provide an insulation barrier which can be put in place in substantially less time than is required for a rigid foamed insulation barrier.

Briefly, the invention provides an insulation barrier which employs a flexible foamed polyethylene body. In this respect, the foamed polyethylene may be made in individual panels, for example, having a width of up to 4 feet and lengths of up to 8 feet. Alternatively, the foamed polyethylene body may be supplied in roll or continuous web form having lengths of 40 to 100 feet or more. Typically, the thickness of the body is from 1/30 to ½ inches and the body has a density of from 0.6 to 10 pounds per cubic foot.

In one embodiment, the insulation barrier includes a film which is secured to at least one side of the flexible foamed polyethylene substrate. In addition, the film extends outwardly of the substrate at least along one edge or peripheral portion thereof. In this respect, the film may be overlapped onto an adjacent panel or winding of the barrier when in use.

Where the insulation barrier is provided in roll form, the barrier may be wound peripherally around a building having exterior sheathing thereon. In this fashion, one worker would hold one end of the roll at one point of the building while a second worker unwinds the roll and wraps the barrier around the building in a plurality of vertically adjacent windings. The projecting edge of the film may then be placed over an adjacent winding to seal any space between the adjacent windings. During unrolling of the barrier, one of the workers or another worker may fasten the barrier to the sheathing using suitable mechanical fasteners, such as staples from a staple gun.

The insulation barrier may also be applied in panels, for example, within the interior of a building. For example, where a building wall is formed of a plurality, spaced-apart vertically disposed studs, panels of the insulation barrier may be installed between the studs in a manner similar to conventional insulation. Alternatively, the insulation barrier may be applied in roll form by being secured to and transversely of the studs for example by staples or other fasteners. In this case, the flexible foamed polyethylene substrate is disposed in contact with the studs while the polyethylene film faces the inside of a room or vice versa. One advantage of placing the barrier across the studs is that there are no air gaps between the studs and the barrier as would be the possibility with panels. Also, when wall boards, such as sheet rock boards, are subsequently secured to the wall, the barrier is compressed between the respective wall board and a respective stud and the wall boards present a flat appearance to the finished wall.

The insulation barrier may also be used in floors and walls and particularly to damp out creaking noises and the like. In this case, the barrier also acts as a noise insulator.

The film and/or the foamed substrate of the insulation barrier may also be provided with a plurality of small holes to permit the passage of moisture vapor. In this respect, the holes are of a micro-size which is sufficient to permit passage of moisture vapor in response to a difference in air pressure on opposite sides of the barrier. Typically, the holes are spaced apart a distance of from 1 inch to 12 inches from each other.

While the foam substrate is made of polyethylene, the film which is applied to the substrate may be made of any suitable material, for example, the film may be selected from a group consisting of paper and plastic such as polyethylene and polypropylene. Further, the film may be provided with a heat-reflective coating, such as a silver coating on one side, or the film may be provided with a heat-absorbing coating, such as a blackened surface on one side. Still further, the foam substrate may be made with a suitable flame retardant compound, to have a flame retardant characteristic.

The insulation barrier may thus be used with the foam polyethylene body by itself or with a film on one or both sides of the foam body.

The insulation barrier has many uses in addition to those described above. For example, one excellent use for the insulation is as an insulation and vapor barrier in the construction of a mobile home. One interesting characteristic of the foam in this regard is that the foam eliminates the creaking which otherwise occurs with rigid foams and thus reduces noise.

An additional advantage of the flexible nature of the foam polyethylene body is that the material will stretch about any fastener which is used to secure the barrier to a structure. In the case of rigid foams, any movement of the rigid foam relative to the structure will cause the fastener to tear the rigid foam thereby leaving a hole through the foam. On the other hand, the flexible polyethylene foam stretches about the fastener and avoids tearing.

Still another advantage of the foam body is that the body is resiliently compressible. Thus, where the insulation barrier is secured to a wall stud or a floor or ceiling beam by a fastener, the insulation barrier is compressed by the fastener in the localized area about the fastener. At the same time, due to the resilient nature of the foam body, a spring-like bias is imposed on the fastener to maintain the fastener tight against the insulation barrier. Hence, the wall stud (or beam), fastener and insulation barrier form a rigid composite construction against vibrations which might otherwise cause relative movements between any two of these three components. In this way, "creaking" noises due to relative motions between the components are avoided.

In still another embodiment, the foamed polyethylene substrate may be embossed so as to have a plurality of spaced apart embossments on at least one side. In addition, where the barrier employs a film over the substrate, the film may also be embossed so that the film defines a plurality of pockets with each pocket receiving a respective embossment. In such an embodiment, air can be allowed to circulate between the film pockets so as to avoid entrapment of any moisture and, thus, any resulting damage to adjacent siding, roofing and/or flooring.

These and other objects and advantages of the invention will become more apparent from the following detailed description taken in conjunction with the accompanying drawings wherein:

FIG. 1 schematically illustrates a building having sheathing on the exterior in the process of being wrapped with an insulation barrier in accordance with the invention;

FIG. 2 illustrates the building of FIG. 1 with a plurality of windings of the insulation barrier thereon;

FIG. 3 illustrates an insulation barrier in panel form in accordance with the invention;

FIG. 4 illustrates a view taken on line 4—4 of FIG. 3;

FIG. 5 illustrates a part-cross-sectional view of a building wall having an insulation barrier in accordance with the invention secured to the outside sheathing thereof in accordance with the invention; and FIG. 6 illustrates a wall similar to FIG. 5 with the insulation barrier secured on the inside.

Referring to FIG. 1, a building 10 of typically conventional construction is illustrated having exterior sheathing 11 thereon. In accordance with the invention, an insulation barrier 12 is provided in roll form so as to be wound about the periphery of the building 10 to encase at least the outside walls in a plurality of vertically adjacent windings 13 as illustrated in FIG. 2. Winding of the roll 12 may be accomplished by having a worker secure one end of the roll to the outside of the building as indicated in FIG. 1 while a second worker unwinds the roll 12 about the building. At the same time, this or another worker may secure the windings 13 to the building using mechanical fasteners, such as staples from a staple gun. Once the building 10 has been wrapped, a worker may manually cut out sections of the windings 13 over door openings 14 and window openings 15 in the building. Such a technique is known.

Referring to FIGS. 3 and 4, the insulation barrier 12 is formed of a flexible foamed polyethylene substrate 16 and a film 17 which is secured to at least one side of the substrate. As indicated, the film 17 extends outwardly of the substrate 16 at least along one lateral edge to form a lip 18 for example, of a 2 inch width. By way of example, the substrate may be made as a continuous web having a width of from 24 inches to 72 inches, a thickness of from 1/32 inches to ½ inches, and a density of from 0.6 to 10 pounds per cubic foot.

As indicated in FIG. 3, the film 17 is provided with a plurality of small holes 19 each of which is sized to permit the passage of moisture vapor therethrough in response to a difference in air pressure on opposite sides of the barrier 12. For example, the holes 19 are of micro-size and are spaced apart a distance of from one inch to twelve inches from each other. In this respect, the holes may be characterized as being of "valve-type" shape so that if the air pressure on opposite sides of the film are equal, no moisture vapor passes through the openings as the openings are substantially closed. However, should a differential pressure occur, the film about each opening tends to deflect in the direction of less pressure so that the hole opens in order to permit moisture vapor to pass through.

Referring to FIG. 5, the building is typically made of walls having spaced apart studs 20 to which the sheathing 11 is secured by suitable fasteners such as nails 21. The insulation barrier 12 is secured to the sheathing 11 in a manner that the lip 18 of the film 17 of each winding 13 overlaps the adjacent winding 13 so as to close off the space between the adjacent windings.

Referring to FIG. 6, the insulation barrier 12 may also be secured on the inside of a building wall. In this respect, the insulation barrier 12 may be secured to the studs 20 by extending transversely of the studs. For example, one strip of the insulation barrier may extend across one wall of an interior room of the building. In any event, the barrier 12 is secured so that the foamed polyethylene substrate 16 is in contact with the studs 20 while the polyethylene film 17 faces the interior (or exterior) of the building. After the insulation barrier 12 has been secured to the studs 20, a plurality of wall boards 22 such as sheet rock, are secured to the wall via suitable fasteners 21 so that the barrier 12 is sandwiched between the wall boards 22 and studs 20. At this time, the barrier 12 is compressed between a respective wall board and a respective stud.

The insulation barrier 12 may be made in a relatively simple manner. For example, a flexible polyethylene foam can be extruded through a die to form a continuous sheet ranging from 1/32 to 2 inches thickness. After extrusion, the film 17, such as a polyethylene film, is laminated to the foamed polyethylene substrate 16, for example with a 2 inch overlap of the film 17 to one side of the substrate. The resulting web can then be rolled on a core or cut in previously determined lengths to fit each specific construction use. If in roll form, the insulation barrier 12 may be applied to a building as described above with respect to FIGS. 1 and 2. In this case, the lip 18 may be provided with adhesive so that a tighter seal can be made between the windings of the barrier 12. After the insulation barrier has been applied to a building, the usual siding can be secured to the exterior of the building over the insulation barrier 12.

The fact that the insulation barrier 12 is flexible permits the barrier to be used in a relatively simple efficient and rapid manner in roll form. Further, the fact that the foamed polyethylene substrate is compressible allows the barrier to be sandwiched between siding and sheathing or between studs and wall boards in a compressed manner for a strong solid contact.

The insulation barrier provides an excellent barrier to the passage of moisture vapor. Alternatively, in order to permit vapor to pass through, the film 17 may be provided with holes 19 as described above.

The insulation barrier has excellent heat insulation properties such as having an R factor of from 2 to 2.77 for a thickness of ¼ inches.

The insulation barrier has excellent waterproofing characteristics. Consequently, the insulation barrier may be applied to a basement wall or the like below grade so as to prevent water from passing through the wall.

Other characteristics of the insulation barrier include the ease of handling of the barrier in roll form or in panel form as well as the ease of installation of either. Further, the insulation barrier is of lightweight construction and the cost is economical.

During manufacture of the foamed polyethylene, the density, thickness and width may be controlled in any suitable manner depending upon the ultimate use to which the barrier is to be placed.

By way of example, use has been made of a ¼ inch thick barrier having a density of 1.2 pounds per cubic foot and supplied in roll form having a width of 48 inches with an R factor of 2.77. A structure 20 feet long and 20 feet wide with a height of 12 feet was wrapped and stapled in four hours by two men with windows and doors cut out and sealed by a third man. The structure was completely ready for siding and had a substrate of ½ inch ply wood.

The foam served not only as an insulation barrier but also as a vapor barrier. Had the structure been insulated with rigid sheets of polystyrene foam, such would have taken twice the time to complete.

The same process was carried out with a barrier having a thickness of ½ inch width the same density and dimensions as above with the same results.

One characteristic of the insulation barrier on a mobile home was that the flexible foam eliminated the creaking normally associated with rigid foams thereby reducing noise.

The fact that the barrier is flexible allows siding placed thereon to fit tightly. That is, when the siding is installed, the foam is compressed so that pressure is always on the siding to hold the siding tight. Thus, there is no rubbing of the siding against the insulation barrier.

Other advantages of the insulation barrier include the fact that the barrier does not shrink unlike polystyrene foams and other rigid foams.

The insulation barrier may be used not only on the sides of structures but also on roofs. The barrier is excellent for flooring as the barrier will not only insulate but also reduce noise. Thus, the movement of people on a floor above is cushioned by the insulation barrier in the floor thereby reducing any sound of the movement from passing to the floor below and stops creaking.

By way of example, as indicated in FIG. 1, the building 10 has a floor including a plurality of beams 23 and a deck 24 secured to and over the beams 23. In accordance with the invention, a plurality of insulation panels 25 are disposed between the beams 23 with each panel 25 being formed, as above, of a flexible foamed polyethylene.

In similar fashion, the building has a ceiling which includes a plurality of beams 26 and a ceiling membrane 27 which is secured to and under the beams 26. In accordance with the invention, insulation panels 28 are disposed above the membrane 27 and each panel 28 is formed of a flexible foamed polyethylene as above. The panels 28 may be disposed between the ceiling beams 26 or may be secured to the underside of the beams 26 so as to be disposed between the membrane 27 and the beams 26. In similar fashion, the panels 25 may be secured between the floor beams 23 and the deck 24.

In another embodiment, the substrate in the insulation barrier may be embossed to have a plurality of spaced apart embossments, e.g. of hemispherical shape on at least one side which project from the barrier and which define channels for a flow of air across the embossed surface of the barrier. Where a film is used on the substrate, the film may also be provided with a plurality of pockets with each pocket having a respective embossment of the substrate therein. Embossment in this manner will add to the insulation properties of the barrier due to the entrapment of air. Alternatively, air may be allowed to circulate between the embossments and the film pockets so as to avoid entrapment of any moisture and thus, the possibility of rotting any siding, roofing and/or flooring with which the barrier is used.

The embossed barrier is also suitable for packaging purposes. For example, the barrier may be formed into a flat embossed packaging element of a length which can be wrapped about an item to be packaged in a carton. In addition, a sheet of the foam substrate may be folded on itself and secured along two sides to form a bag-like structure for receiving items which are to be cushioned for shipping purposes and the like. Alternatively, a pair of flat embossed flexible foamed polyethylene bodies or sheets can be secured to each other along at least a portion of the respective peripheries, e.g. along two or three edges in order to form a similar sleeve-like or bag-like structure having a pocket to receive an item to be protected. Still further, a film may be laminated to the outside of the resultant bag in order to strengthen the bag for shipping purposes. Also, the surfaces of the foamed bodies which face each other may be provided with embossments.

The embossed embodiment of the foamed structure may also be used for the shipment of painted furniture. For example, it has been known to spray paint hard furniture and to thereafter place the painted furniture in a heating chamber or the like to effect a cure of the paint. However, in many circumstances, the volatile solvents of the paint do not completely escape during the curing process so that when the furniture is subsequently wrapped with packaging material and shipped in a carton, the paint becomes softened during shipment by the volatile solvents and the packaging material mars the painted surface. Using the embossed embodiment with the embossments of the insulation facing the furniture allows the volatile solvents to escape along the channels defined by the embossments into the surrounding environment and away from the painted surfaces. Thus, the embossed insulation barrier becomes an excellent cushioning material for the shipment of the painted furniture which allows the painted surfaces to breathe. In this respect, the spacing and sizing of the embossments are not critical so long as the spacing and size of the embossments allow the volatile solvents to escape along the channels between the embossments. By way of example, the spacing of the embossments may be from 1/16 inch to 1 inch. In this respect, the spacing of the embossments should be such as to maintain a bridge-like effect in the foam substrate between adjacent embossments so as to maintain channels or passageways for the volatile solvents.

The embossed barrier not only cushions and protects but can also be made into large bags to cover furniture such as chairs, couches, tables and the like. Further, such a bag may be reused.

The insulation barrier is found to be an excellent insulator for boats as water will not effect the barrier. Further, if the barrier becomes wet, any water will drain out and add to the floatation characteristics of the boat.

The barrier is excellent for airplane insulation as the barrier will allow the pressure to change within the cabin of the plane as the barrier does not trap air.

What is claimed is:

1. In combination, a building having exterior sheathing thereon;

an insulation barrier disposed peripherally around said building, said barrier including a flexible foamed polyethylene substrate having a thickness of from 1/30 to ½ inches in contact with said sheathing; and a plurality of fasteners securing said barrier to said sheathing.

2. The combination as set forth in claim 1 wherein the barrier is formed of individual panels.

3. The combination as set forth in claim 2 which further comprises a polyethylene film secured to and over each said panel, said film extending laterally outwardly of said panel in overlapping relation to an adjacent panel.

4. The combination as set forth in claim 3 wherein said film has a plurality of small holes therein, said holes being sized to permit passage of moisture vapor therethrough in response to a difference in air pressure on opposite sides of said barrier.

5. The combination as set forth in claim 1 wherein said barrier is external to said sheathing.

6. In combination, a building having at least one wall including a plurality of spaced apart vertically disposed studs;

an insulation barrier secured to said wall, said barrier being secured to and extending transversely of said studs and having a flexible foamed polyethylene substrate of a thickness of from 1/30 to 2 inches in contact with said studs; and plurality of fasteners passing through said barrier into said studs to secure said barrier directly to said studs and to resiliently compress said barrier thereat for a strong solid contact for thermal insulation and for noise insulation.

7. The combination as set forth in claim 6 which further comprises a plurality of wall boards secured to said wall with said barrier sandwiched therebetween, said barrier being compressed between a respective wall board and a respective stud.

8. The combination as set forth in claim 7 wherein said substrate has a plurality of small holes therein, said holes being sized to permit passage of moisture vapor therethrough in response to a difference in air pressure on opposite sides of said barrier.

9. The combination as set forth in claim 6 wherein said barrier extends horizontally of said studs.

10. In combination a building having a plurality of horizontal beams and a horizontal deck to form a floor;

an insulation barrier disposed between said beams and said deck, said barrier including a flexible foamed polyethylene substrate of a thickness of from 1/30 to 2 inches in contact with said beams and said deck; and a plurality of fasteners securing said barrier to said beams and said deck to resiliently compress said barrier thereat for a strong solid contact for thermal insulation and for noise insulation.

11. The combination as set forth in claim 10 wherein the barrier is formed of individual panels.

12. The combination as set forth in claim 11 which further comprises a polyethylene film secured to and over each said panel, said film extending laterally outwardly of said panel in overlapping relation to an adjacent panel.

13. The combination as set forth in claim 12 wherein said film has a plurality of small holes therein, said holes being sized to permit passage of moisture vapor therethrough in response to a difference in air pressure on opposite sides of said barrier.

14. In combination, a building having exterior sheathing thereon;

an insulation barrier disposed peripherally around said building, said barrier including a plurality of panels, each panel comprising a flexible foamed polyethylene substrate in contact with said sheathing and a polyethylene film secured to and over said panel, said film extending laterally outwardly of said panel in overlapping relation to an adjacent panel; and a plurality of fasteners securing said barrier to said sheathing.

15. The combination as set forth in claim 14 wherein said film has a plurality of small holes therein, said holes being sized to permit passage of moisture vapor therethrough in response to a difference in air pressure on opposite sides of said barrier.

16. In combination a building having a plurality of horizontal beams and a horizontal membrane to form a ceiling;

an insulation barrier disposed between said beams and said membrane, said barrier including a flexible foamed polyethylene substrate of a thickness of from 1/30 to 2 inches in contact with said beams and said membrane; and a plurality of fasteners securing said barrier to said beams and said membrane to resiliently compress said barrier thereat for a strong solid contact for thermal insulation and for noise insulation.

17. The combination as set forth in claim 16 wherein the barrier is formed of individual panels.

18. The combination as set forth in claim 17 which further comprises a polyethylene film secured to and over each said panel, said film extending laterally outwardly of said panel in overlapping relation to an adjacent panel.

19. The combination as set forth in claim 18 wherein said film has a plurality of small holes therein, said holes being sized to permit passage of moisture vapor therethrough in response to a difference in air pressure on opposite sides of said barrier.

* * * * *